US007463014B2

(12) United States Patent
Loi et al.

(10) Patent No.: US 7,463,014 B2
(45) Date of Patent: Dec. 9, 2008

(54) HIGH IMPEDANCE CURRENT MIRROR WITH FEEDBACK

(75) Inventors: Chang-Feng Loi, Singapore (SG); Kumar s/o Krishnasamy Maniam Nuntha, Singapore (SG); Hung I Khoo, Singapore (SG); Kin Soon Liew, Singapore (SG); Jun Xia, Singapore (SG)

(73) Assignee: Avago Technologies General IP (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 11/711,748

(22) Filed: Feb. 28, 2007

(65) Prior Publication Data

US 2007/0200545 A1 Aug. 30, 2007

(51) Int. Cl.
*G05F 3/16* (2006.01)

(52) U.S. Cl. ..... 323/316

(58) Field of Classification Search ..... 323/315, 323/316

See application file for complete search history.

(56) References Cited

U.S. PATENT DOCUMENTS 4,924,113 A * 5/1990 Schade, Jr. ..... 323/316
4,978,868 A * 12/1990 Giordano et al. ..... 327/539
6,522,118 B1 * 2/2003 Barcelo et al. ..... 323/316
6,897,714 B2 * 5/2005 Mori ..... 327/541
7,026,802 B2 * 4/2006 Gradinariu ..... 323/316
7,118,274 B2 * 10/2006 Van Phan et al. ..... 374/178
7,119,527 B2 * 10/2006 Fernald ..... 323/315
7,224,156 B2 * 5/2007 Chen ..... 323/316
7,253,597 B2 * 8/2007 Brokaw ..... 323/314
2005/0151528 A1 * 7/2005 Marinca ..... 323/316
2005/0194957 A1 * 9/2005 Brokaw ..... 323/316
2007/0170906 A1 * 7/2007 Marinca ..... 323/316
2007/0194771 A1 * 8/2007 Chen ..... 323/316

OTHER PUBLICATIONS

RF, RFIC & Microwave Theory, Design; www.rfic.co.uk; Improved Cascode Current Mirror; pp. 1-7.

* cited by examiner

*Primary Examiner*—Jeffrey L Sterrett

(57) ABSTRACT

A current supply includes a current mirror arrangement having a feedback circuit. The current supply includes a current mirror input stage connected to a constant current source providing a reference current; a current mirror output stage providing an output current substantially mirroring the reference current; and a feedback circuit feeding back to the current mirror input stage a feedback signal representing perturbations in the output current to cause the output current to more accurately mirror the reference current. In one embodiment, a dummy current mirror output stage substantially mirrors the reference current, and the feedback circuit receives a signal from the dummy current mirror output stage, and in response thereto, supplies the feedback signal to the current mirror input stage to cause the output current to more accurately mirror the reference current.

20 Claims, 4 Drawing Sheets

HIGH IMPEDANCE CURRENT MIRROR WITH FEEDBACK

BACKGROUND

Current supplies are used in a wide variety of analog circuits. As the term is used herein, a "current supply" can be either a current source that drives current from a higher voltage (e.g., Vcc) through an output load to a lower voltage (e.g., ground), or a current sink that receives current from a higher voltage (e.g., Vcc) through an output load and provides it to a lower voltage (e.g., ground). A current supply should ideally have the following characteristics: (1) maintains a constant current regardless of the voltage level at the output node; and (2) maintains a very high output impedance at all frequencies from DC to infinite frequency.

One very common arrangement used in a current supply is a current mirror arrangement. The objective of the current mirror arrangement is to accurately copy a reference current while attempting to preserve the output characteristics of an ideal current supply, as set forth above.

FIG. 1 illustrates a first embodiment of a current supply 100 having a current mirror arrangement. Current supply 100 is a current mirror arrangement, including a current mirror input stage 120 and a current mirror output stage 160. Current mirror input stage 120 comprises a first transistor 130 that is connected to a constant current source 140 providing a substantially constant current, Iref. Current mirror output stage 160 comprises a second transistor 170 sinking an output current Iload from an output load 190. Because current mirror output stage 160 includes only a single transistor 170, it is sometimes referred to as a "single stack" current mirror arrangement.

In current supply 100, first and second transistors 130 and 170 each have a first terminal, a second terminal, and a control terminal. The first terminal of second transistor 170 is connected to the first terminal of first transistor 130. In the embodiment of FIG. 1, both of these first terminals are connected to ground. In another embodiment the first terminals could be connected to a low supply voltage, including a negative supply voltage. Also, the control terminals of first and second transistors 130 and 170 are connected together to each other. Meanwhile, the second terminal and the control terminal of first transistor 130 are also connected together.

Although current supply 100 is configured as a current sink or "active load," in another embodiment, the first terminals of first and second transistors 130 and 170 may be connected to a high (e.g., positive Vcc) supply voltage, in which case current supply 100 operates as a current source.

Ideally, the current mirror output stage 160 has two characteristics: (1) its current (Iload) accurately mirrors the current (Iref) through the current mirror input stage 120; and (2) it maintains a very high output impedance from DC to infinite frequency. Equation (1) expresses the relationship between Iload and Iref in the current supply 100:

$$Iload/Iref=[(W2/L2)/(W1/L1)]*[(1+\lambda*VDS2)/(1+\lambda*VDS1)] \quad (1)$$

where: W2 is the channel width of second transistor 170; L2 is the channel length of second transistor 170; W1 is the channel width of first transistor 130; L1 is the channel length of first transistor 130; λ is a process parameter for the fabrication of first and second transistors 130, 170; VDS2 is the drain-to-source voltage of second transistor 170, and VDS1 is the drain-to-source voltage of first transistor 130.

To maintain a current mirror relationship (i.e., Iload=Iref), then first and second transistors 130 and 170 should be perfectly matched. In other words, the ratio W2/L2, for second transistor 170 should be equal to W1/L1 for first transistor 130. In that case, since VGS1=VGS2 in the configuration of FIG. 1, then VDS1≈VDS2. Accordingly, from equation (1), Iload≈Iref.

So the current mirror arrangement of current supply 100 can allow second transistor 170 to maintain a substantially constant output current Iload that substantially mirrors the constant current Iref, despite variations in the impedance of output load 190.

However, there are some disadvantages and limitations to current supply 100. In particular, the output impedance of the second transistor 170 is often not as high as desired. In that case, changes of VDS2 due to changes or perturbations to output load 190 (e.g., ripple or switching noise on a power supply voltage to which output load 190 is connected) can affect the current Iload.

According, to increase the output impedance of the current supply, a current supply having a cascode current mirror arrangement has been developed. Indeed, a number of different cascode current mirror arrangements have been developed.

FIG. 2 shows a current supply 200 having a low-dropout voltage cascode current mirror arrangement. Current supply 200 comprises a biasing circuit 210, a current mirror input stage 220, and a current mirror output stage 260. This arrangement is referred to as "low-dropout voltage" because the voltage across current mirror output stage 260 can drop to a lower voltage level than in a "regular" cascode current mirror arrangement. This arrangement is instead sometimes referred to as a "high-swing" cascode current mirror arrangement because it enables larger voltage swings on the output load.

Current mirror input stage 220 comprises a first transistor 230 and a third transistor 275 that are connected in series with a constant current source 240 providing a current Iref. Current mirror output stage 260 comprises a second transistor 270 and a fourth transistor 280 that are connected in series with an output load 290. Meanwhile, biasing circuit 210 includes a fifth (bias) transistor 295 supporting a current Ibias at a first terminal thereof In current supply 200, first, second, third, fourth, and fifth transistors 230, 270, 275, 280 and 295 each have a first terminal, a second terminal, and a control terminal. The first terminal of first transistor 230, second transistor 270, and fifth transistor 295 are connected together. In the embodiment of FIG. 2, all of these first terminals are connected to ground. In another embodiment the first terminals of first, second, and fifth transistors 230, 270 and 295 could be connected to a low supply voltage, including a negative supply voltage. Also, the control terminals of first and second transistors 230 and 270 are connected together to each other, and to the second terminal of third transistor 275. Furthermore, the first terminal of third transistor 275 is connected to the second terminal of first transistor 230, and the first terminal of fourth transistor 280 is connected to the second terminal of second transistor 270. Finally, the control terminals of third and fourth transistor 275 and 280 are connected together and are both also connected to the control terminal of fifth transistor 215.

Although current supply 200 is configured as a current sink or "active load," in another embodiment the first terminals of first, second, and fifth transistors 230, 270, and 295 may be connected to a high (e.g., positive Vcc) supply voltage, in which case current supply 200 operates as a current source.

As explained above, ideally current mirror output stage 260 has two characteristics: (1) its current (Iload) accurately mirrors the current (Iref) through the current mirror input stage 220; and (2) it maintains a very high output impedance from DC to infinite frequency.

In the current supply 200, first, second, third, and fourth transistors 230, 270, 275 and 280 are all operated in saturation. Equation (2) provides that the output current of a current mirror whose output transistor is in saturation is:

$$I\text{load}=K(VGS-VTH)^2*(1+\lambda*VDS) \quad (2)$$

where K and λ are process parameters.

The current Iref can be perfectly mirrored to Iload if VDS1=VDS2. Meanwhile, in the cascode current mirror arrangement of FIG. 2, VDS1 will equal VDS2 if VGS3=VGS4. Thus fourth transistor 280 effectively shields VDS2 of second transistor 270 from changes or perturbations to output load 290 (e.g., ripple on a power supply voltage to which output load 290 is connected). From FIG. 2 it can be seen that:

$$VDS2=VGS5-VGS3,4 \quad (3)$$

So the current mirror arrangement of current supply 200 can allow second transistor 270 to maintain a substantially constant output current Iload that substantially mirrors the constant current Iref, despite wide variations in the voltage of output load 290.

However, there are some disadvantages and limitations to current supply 200. In particular, in comparison to the current supply 100, the headroom is substantially reduced. That is, for current supply 100 to remain in saturation, the minimum output voltage $VOUT_{100}$, is found by Equation (4):

$$VOUT_{100}=VDS_{SAT2} \quad (4)$$

In contrast, for current supply 200, the minimum output voltage $VOUT_{200}$, is found by Equation (5):

$$VOUT_{200}=2*VDS_{SAT3,4} \quad (5)$$

In order to reduce $VOUT_{200}$ to be near to $VOUT_{100}$, then the size of second and fourth transistors must be substantially increased (quadrupled). That is, the transistors 230, 270, 275, and 280 in current supply 200 must each be four times as large as the transistors 130 and 170 in current supply 100. However, when the size of second and fourth transistors 270 and 280 is increased, then the parasitic capacitance of the devices is also increased. Since impedance is inversely proportional to capacitance at a particular frequency, this means that the output impedance is reduced. This in turn degrades the high frequency performance of the current supply. Meanwhile, as fabrication process parameters continue to shrink, supply voltages of devices are being reduced, and operating frequencies are increasing. As a result, the headroom that is required to maintain the current mirror in saturation limits the maximum output swing of the current supply.

So it is seen that while current supply 200 can improve (increase) the output impedance over current supply 100 at lower frequencies, current supply 200 has a disadvantage that at higher frequencies, its output impedance is decreased compared to current supply 100, given the same headroom.

What is needed, therefore, is a current supply with a high output impedance from DC to a very high frequency that can operate with a low headroom.

SUMMARY

In an example embodiment, a current supply comprises: a current mirror input stage adapted to be connected to a constant current source providing a reference current; a current mirror output stage substantially mirroring the reference current of the current mirror input stage; a dummy current mirror output stage substantially mirroring the reference current of the current mirror input stage; and a difference amplifier. The current mirror input stage includes a first transistor having first and second terminals and a control terminal, and a control transistor connected between the control terminal of the first transistor and the second terminal of the first transistor. The current mirror output stage includes a second transistor having first and second terminals and a control terminal, the control terminal being connected to the control terminal of the first transistor and the first terminal being connected to the first terminal of the first transistor. The dummy current mirror output stage includes a model load and a third transistor having first and second terminals and a control terminal, the control terminal being connected to the control terminal of the first transistor, the first terminal being connected to the first terminal of the first transistor, and the second terminal being connected to the model load. The difference amplifier has a first input connected to the second terminal of the first transistor, a second input connected to the second terminal of the third transistor, and an output connected to a control terminal of the control transistor.

In another example embodiment, a current supply comprises a current mirror input stage adapted to be connected to a constant current source providing a reference current; a current mirror output stage substantially mirroring the reference current of the current mirror input stage; and a difference amplifier. The current mirror input stage includes a first transistor having first and second terminals and a control terminal, and a control transistor connected between the control terminal of the first transistor and the second terminal of the first transistor. The current mirror output stage includes a second transistor having first and second terminals and a control terminal, the control terminal being connected to the control terminal of the first transistor and the first terminal being connected to the first terminal of the first transistor. The difference amplifier has a first input connected to the second terminal of the first transistor, a second input connected to the second terminal of the second transistor, and an output connected to a control terminal of the control transistor.

In yet another example embodiment, a current supply comprises a current mirror input stage providing a reference current; a current mirror output stage providing, to an output load, an output current substantially mirroring the reference current of the current mirror input stage; and a feedback circuit feeding back to the current mirror input stage a feedback signal representing perturbations in the output load, to cause the output current to more accurately mirror the reference current.

BRIEF DESCRIPTION OF THE DRAWINGS

The example embodiments are best understood from the following detailed description when read with the accompanying drawing figures. It is emphasized that the various features are not necessarily drawn to scale. In fact, the dimensions may be arbitrarily increased or decreased for clarity of discussion. Wherever applicable and practical, like reference numerals refer to like elements.

DETAILED DESCRIPTION

In the following detailed description, for purposes of explanation and not limitation, example embodiments disclosing specific details are set forth in order to provide a thorough understanding of an embodiment according to the present teachings. However, it will be apparent to one having ordinary skill in the art having had the benefit of the present disclosure that other embodiments according to the present teachings that depart from the specific details disclosed herein remain within the scope of the appended claims. Moreover, descriptions of well-known apparati and methods maybe omitted so as to not obscure the description of the example embodiments. Such methods and apparati are clearly within the scope of the present teachings.

Figure 1:
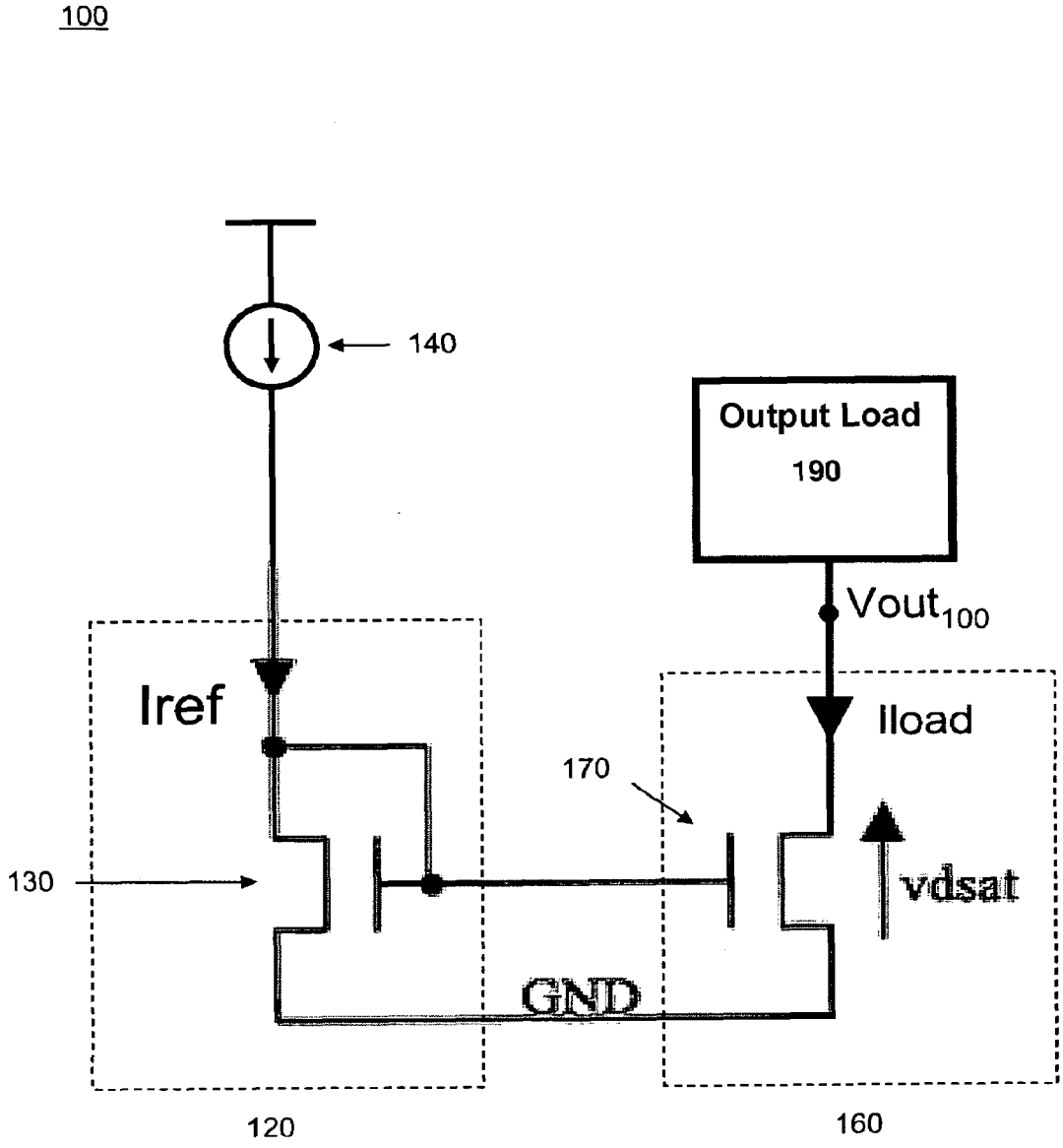
FIG. 1 shows a current supply including a single stack current mirror arrangement.
Figure 2:
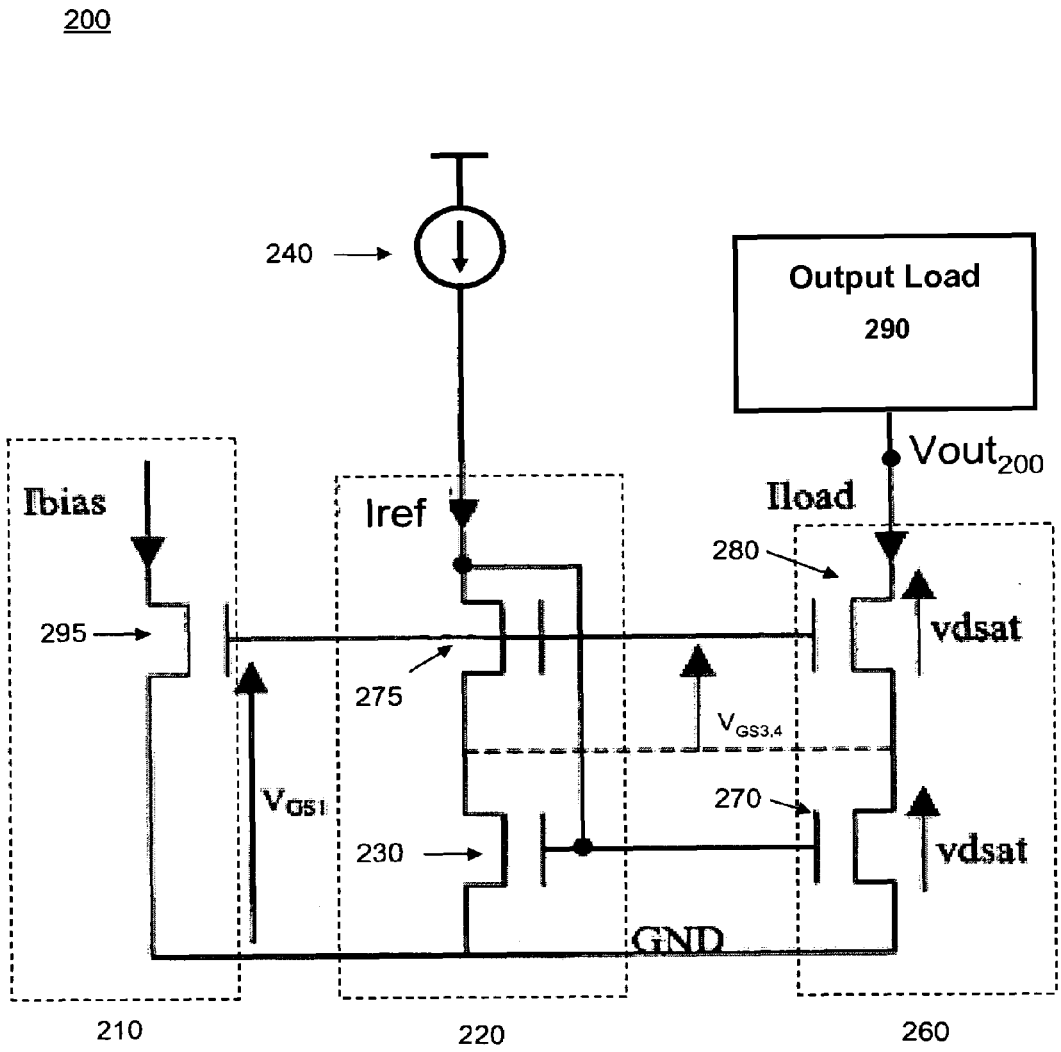
FIG. 2 shows a current supply including a cascode current mirror arrangement.
Figure 3:
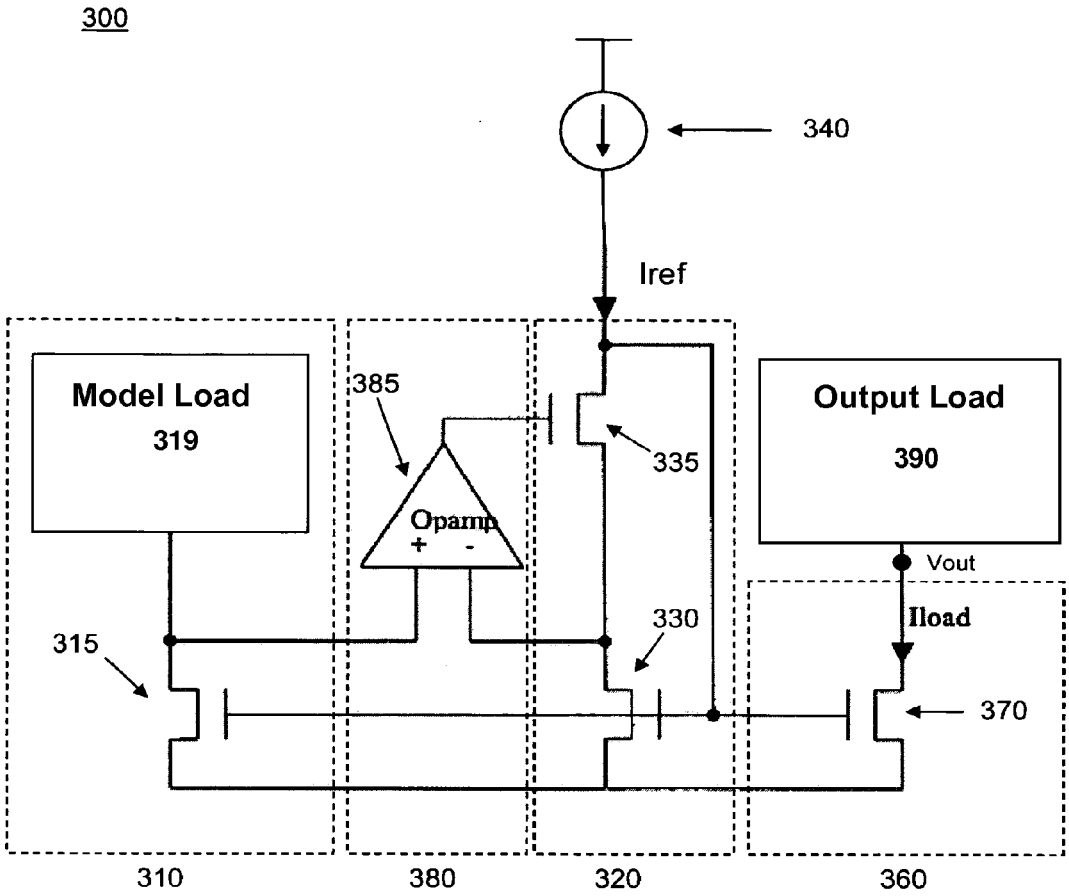
FIG. 3 shows one embodiment of a current supply including a current mirror with a feedback circuit.

FIG. 3 shows one example embodiment of a current supply 300 having a current mirror arrangement with feedback. Current supply 300 comprises a current mirror input stage 320, a current mirror output stage 360, a dummy current mirror output stage 310, and a feedback circuit 380. Current mirror input stage 320 comprises a first transistor (e.g., a MOSFET) 330 and a control transistor (e.g., a MOSFET) 335 connected in series to a constant current source 340 providing a substantially constant current, Iref. Control transistor 335 is connected in a source-follower configuration. Current mirror output stage 360 comprises a second transistor (e.g., a MOSFET) 370 sinking an output current Iload from an output load 390. Because current mirror output stage 360 includes only a single transistor 370, it is sometimes referred to as a "single stack" current mirror arrangement.

Of note, current supply 300 also includes dummy current mirror output stage 310 and feedback circuit 380. Dummy current mirror output stage 310 includes a third transistor (e.g., a MOSFET) 315 and model load 319. Current supply 300 will work best when model load 319 is configured to match the actual output load 390 as closely as possible. Meanwhile, feedback circuit 380 comprises a difference amplifier 385 providing a feedback signal to current mirror input stage 320. As shown in FIG. 3, difference amplifier 385 is a standard operational amplifier. However, any amplifier or other circuit that has first and second inputs and produces an output that reflects the difference between the voltage at the first input and the voltage at the second input, could be employed.

In current supply 300, first and second transistors 330 and 370, control transistor 335, and third transistor 315 each have a first terminal, a second terminal, and a control terminal. The first terminal of second transistor 370 is connected to the first terminal of first transistor 330 and the first terminal of third transistor 315. In the embodiment of FIG. 3, the first terminals of transistors 330, 370, and 315 are connected to ground. In another embodiment these first terminals could be connected to a low supply voltage, including a negative supply voltage. Also, the control terminals of first transistor 330, second transistor 370, and third transistor 315 are connected together to each other. Additionally, the second terminal of control transistor 335 and the control terminal of first transistor 330 are also connected together. Furthermore, the second terminal of first transistor 330 is connected to the first terminal of control transistor 335.

Meanwhile, the non-inverting input of difference amplifier 385 is connected to the second terminal of third transistor 315, the inverting input of difference amplifier 385 is connected to the second terminal of first transistor 330, and the output of difference amplifier 385 is connected to the control terminal of control transistor 335.

Although current supply 300 is configured as a current sink or "active load," in another embodiment the first terminals of first and second transistors 330 and 370 and third transistor 315 may be connected to a high (e.g., positive Vcc) supply voltage, in which case current supply 300 operates as a current source.

Next, an operation of current supply 300 will be explained.

As explained above, model load 319 is connected to third transistor 315 to model the actual output load 390 connected to the output of current supply 300 through second transistor 370 of current mirror output stage 360. That is, any perturbation in the load or voltage across VDS2 of second transistor 370 should also be reflected across VDS3 of third transistor 315. In that case, difference amplifier 385 will detect the perturbation as a difference between VDS3 and VDS1 and feedback the difference through control transistor 335. This, in turn, will force VDS1 to track VDS3. Since transistors 330, 370, and 315 all have the same VGS, then from equation (5) above, the current Iref will be substantially accurately mirrored in both current mirror output stage 360 (Iload) and in dummy current mirror output stage 310.

As a result, feedback circuit 380 feeds back to current mirror input stage 320 a feedback signal representing perturbations in output load 390 to cause the output current Iload to more accurately mirror the substantially constant current Iref.

Compared to current supply 100 above, for current mirror transistors of the same size, current supply 300 has an increased output impedance at low frequencies. Additionally, compared to current supply 200 with the cascode current mirror arrangement, the current mirror transistor of current supply 300 requires a smaller W/L ratio for the same VOUT than the current mirror transistors of current supply 200. This reduces the drain-bulk capacitance and in turn increases the high frequency impedance and the headroom of the current supply.

Figure 4:
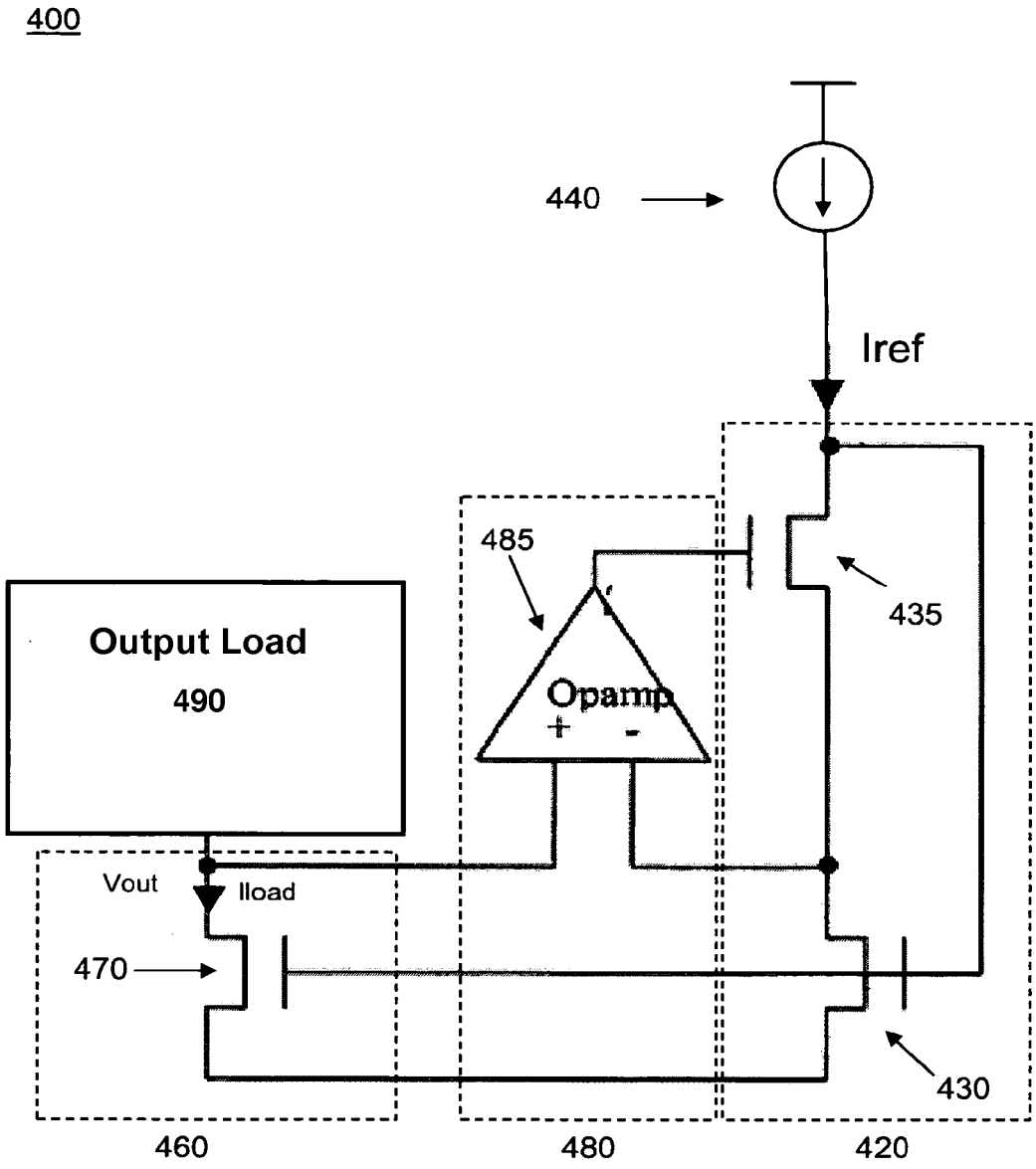
FIG. 4 shows another embodiment of a current supply including a current mirror with a feedback circuit.

FIG. 4 shows another embodiment of a current supply 400 having a current mirror arrangement with feedback. Current supply 400 comprises a current mirror input stage 420, a current mirror output stage 460, and a feedback circuit 480. Current mirror input stage 420 comprises a first transistor (e.g., a MOSFET) 430 and a control transistor 435 connected in series to a constant current source 440 providing a substantially constant current, Iref. Control transistor 435 is connected in a source follower configuration. Current mirror output stage 460 comprises a second (current mirror) transistor (e.g., a MOSFET) 470 sinking an output current Iload from an output load 490. Because current mirror output stage 460 includes only a single transistor 470, this is sometimes referred to as a "single stack" current mirror arrangement.

Of note, current supply 400 also includes feedback circuit 480. Feedback circuit 480 comprises a difference amplifier 485 providing a feedback signal to current mirror input circuit 420. As shown in FIG. 4, difference amplifier 485 is a standard operational amplifier. However, any amplifier or other circuit that has inverting and non-inverting inputs and produces an output that reflects the difference between the voltage at the non-inverting input and the voltage at the inverting input could be employed. However, the difference amplifier should have a very high input impedance and a very small input capacitance so as to minimize its effects on the output impedance and frequency response of current supply 400.

In current supply 400, first and second transistors 430 and 470 and control transistor 435 each have a first terminal, a second terminal, and a control terminal. The first terminal of second transistor 470 is connected to the first terminal of first transistor 430. In the embodiment of FIG. 4, the first terminals of first and second transistors 430 and 470 are connected to ground. In another embodiment these first terminals could be connected to a low supply voltage, including a negative supply voltage. Also, the control terminals of first transistor 430 and second transistor 470 are connected together to each other. Additionally, the second terminal of control transistor 435 and the control terminal of first transistor 430 are also connected together. Furthermore, the second terminal of first transistor 430 is connected to the first terminal of control transistor 435.

Meanwhile, the non-inverting input of difference amplifier 485 is connected to the second terminal of second transistor 470, the inverting input of difference amplifier 485 is connected to the second terminal of first transistor 430, and the output of difference amplifier 485 is connected to the control terminal of control transistor 435.

Although current supply 400 is configured as a current sink or "active load," in another embodiment the first terminals of first and second transistors 430 and 470 may be connected to a high (e.g., positive Vcc) supply voltage, in which case current supply 400 operates as a current source.

Next, an operation of current supply 400 will be explained.

Difference amplifier 485 will detect any perturbation in the load or voltage across VDS2 of second transistor 470 as a difference between VDS2 and VDS1 and feedback the difference through control transistor 435. This, in turn, will force VDS1 to track VDS2. Since transistors 430 and 470 have the same VGS, then from equation (5) above, the current Iref will be substantially accurately mirrored in current mirror output stage 460 (Iload).

As a result, feedback circuit 480 feeds back to current mirror input stage 420 a feedback signal representing perturbations in output load 490 to cause the output current Iload to more accurately mirror the substantially constant current Iref.

It is important in the current supply 400 that the difference amplifier 485 has a very high input impedance and a very low input capacitance so as not to load the output of current mirror output stage 460. If it is assumed that the input impedance of difference amplifier 485 is much higher than the output impedance of current mirror output stage 460, and the input capacitance of difference amplifier 485 is much less than the input capacitance of current mirror output stage 460, then compared to current supply 100 above, for current mirror transistors of the same size, current supply 400 has an increased output impedance. Additionally, compared to current supply 200 with the cascode current mirror arrangement, the current mirror transistor of current supply 300 requires a smaller W/L ratio for the same VDS than the current mirror transistors of current supply 200. This reduces the drain-bulk capacitance and in turn boosts the high frequency performance and headroom of the current supply.

While example embodiments are disclosed herein, one of ordinary skill in the art appreciates that many variations that are in accordance with the present teachings are possible and remain within the scope of the appended claims. The embodiments therefore are not to be restricted except within the scope of the appended claims.

The invention claimed is:

1. current supply, comprising:

a current mirror input stage adapted to be connected to a constant current source providing a reference current the current mirror input stage including, a first transistor having first and second terminals and a control terminal, and a control transistor connected between the control terminal of the first transistor and the second terminal of the first transistor;

a current mirror output stage substantially mirroring the reference current of the current mirror input stage, the current mirror output stage including a second transistor having first and second terminals and a control terminal, the control terminal being connected to the control terminal of the first transistor and the first terminal being connected to the first terminal of the first transistor;

a dummy current mirror output stage substantially mirroring the reference current of the current mirror input stage, the dummy current mirror output stage including, a model load, and a third transistor having first and second terminals and a control terminal, the control terminal being connected to the control terminal of the first transistor, the first terminal being connected to the first terminal of the first transistor, and the second terminal being connected to the model load; and a difference amplifier having a first input connected to the second terminal of the first transistor, a second input connected to the second terminal of the third transistor, and an output connected to a control terminal of the control transistor.

2. The current supply of claim 1, wherein the model load has substantially a same impedance as an output load of the current mirror output stage.

3. The current supply of claim 1, wherein the first, second, third, and control transistors are all MOSFETs.

4. A current supply, comprising:

a current mirror input stage adapted to be connected to a constant current source providing a reference current, the current mirror input stage including, a first transistor having first and second terminals and a control terminal, and a control transistor connected between the control terminal of the first transistor and the second terminal of the first transistor;

a current mirror output stage substantially mirroring the reference current of the current mirror input stage, the current mirror output stage including a second transistor having first and second terminals and a control terminal, the control terminal being connected to the control terminal of the first transistor and the first terminal being connected to the first terminal of the first transistor; and a difference amplifier having a first input connected to the second terminal of the first transistor, a second input connected to the second terminal of the second transistor, and an output connected to a control terminal of the control transistor.

5. The current supply of claim 4, wherein the wherein the first, second, and control transistors are all MOSFETs.

6. A current supply, comprising:

a current mirror input stage adapted to be connected to a constant current source providing a reference current;

a current mirror output stage providing, to an output load, an output current substantially mirroring the reference current of the current mirror input stage; and a feedback circuit feeding back to the current mirror input stage a feedback signal representing perturbations in the output load, to cause the output current to more accurately mirror the reference current.

7. The current supply of claim 6, further comprising a dummy current mirror output stage substantially mirroring the reference current of the current mirror input stage, wherein the feedback circuit receives a signal from the dummy current mirror outputs stage and in response thereto supplies the feedback signal to the current mirror input stage to cause the output current to more accurately mirror the reference current.

8. The current supply of claim 7, wherein the current mirror input stage comprises:

a first transistor having first and second terminals and a control terminal; and a control transistor connected between the control terminal of the first transistor and the second terminal of the first transistor.

9. The current supply of claim 8, wherein the dummy current mirror output stage comprises:

a model load, and a dummy current mirror transistor having first and second terminals and a control terminal, the control terminal being connected to the control terminal of the first transistor, the first terminal being connected to the first terminal of the first transistor, and the second terminal being connected to the model load.

10. The current supply of claim 9, wherein the feedback circuit includes an operational amplifier having an inverting input, a non-inverting input, and an output, wherein the inverting input receives a voltage at the second terminal of the first transistor, the non-inverting terminal receives a voltage at the second terminal of the dummy current mirror transistor, and the output supplies a difference signal to a control terminal of the control transistor.

11. The current supply of claim 10, wherein the current mirror output stage is a single stack arrangement, and the dummy current mirror output stage is also a single stack arrangement.

12. The current supply of claim 9, wherein the first transistor, dummy current mirror transistor, and control transistor are all MOSFETs.

13. The current supply of claim 7, wherein the current mirror output stage is a single stack arrangement, and the dummy current mirror is also a single stack arrangement.

14. The current supply of claim 6, wherein the current mirror input stage comprises:

a first transistor having first and second terminals and a control terminal; and a control transistor connected between the control terminal of the first transistor and the second terminal of the first transistor.

15. The current supply of claim 14, wherein the current mirror output stage is a single stack arrangement comprising a second transistor having first and second terminals and a control terminal, the control terminal being connected to the control terminal of the first transistor and the first terminal being connected to the first terminal of the first transistor.

16. The current supply of claim 15, wherein the feedback circuit includes an operational amplifier having an inverting input, a non-inverting input, and an output, wherein the inverting input receives a voltage at the second terminal of the first transistor, the non-inverting terminal receives a voltage at the second terminal of the second transistor, and the output supplies a difference signal to a control terminal of the control transistor.

17. The current supply of claim 14, wherein the first transistor, second transistor, and control transistor are all MOSFETs.

18. The current supply of claim 6, wherein the current mirror output stage is a single stack arrangement.

19. The current supply of claim 6, wherein the feedback circuit receives a signal from the current mirror output stage and in response thereto supplies the feedback signal to the current mirror input stage to cause the output current to more accurately mirror the reference current.

20. The current supply of claim 6, wherein the feedback circuit includes a difference amplifier outputting the feedback signal to the current mirror input stage.

* * * * *

UNITED STATES PATENT AND TRADEMARK OFFICE

CERTIFICATE OF CORRECTION

PATENT NO. : 7,463,014 B2
APPLICATION NO. : 11/711748
DATED : December 9, 2008
INVENTOR(S) : Chang-Feng Loi et al.

It is certified that error appears in the above-identified patent and that said Letters Patent is hereby corrected as shown below:

First Page, Column 1, under Prior Publication Data,
insert -- Related U.S. Application Data
Continuation of 11/362,049 filed on 02/27/2006, now abandoned --;

Column 7, Line 56, Claim 1, delete "current" and insert -- A current --;

Column 7, Line 58, Claim 1, delete "reference current the"
and insert -- reference current of the --;

Column 8, Line 46, Claim 5, delete "wherein the wherein the"
and insert -- wherein the --.

Signed and Sealed this
First Day of March, 2011

David J. Kappos

David J. Kappos
*Director of the United States Patent and Trademark Office*